United States Patent [19]

Faltin

[11] 4,315,588

[45] Feb. 16, 1982

[54] HIGH SPEED ON-LINE STITCHER FOR SIGNATURES AND WEBS

[76] Inventor: Hans G. Faltin, 4135 Wilshire Dr., York, Pa. 17401

[21] Appl. No.: 113,671

[22] Filed: Jan. 21, 1980

[51] Int. Cl.[3] ..... B42C 1/00

[52] U.S. Cl. ..... 227/81; 227/39; 227/44; 227/100; 227/103

[58] Field of Search ..... 29/429, 432.1; 227/81, 227/84, 85, 92, 100, 101, 103, 91, 20, 30, 39, 40, 44; 270/17, 53

[56] References Cited

U.S. PATENT DOCUMENTS

| | | | |
|---|---|---|---|
| Re. 13,967 | 8/1915 | Juengst | 227/84 |
| 964,202 | 7/1910 | Bonnesen et al. | 227/81 |
| 1,534,141 | 4/1925 | Roesen | 227/81 |
| 1,608,838 | 11/1926 | Christensen | 227/81 |
| 1,676,156 | 7/1928 | Rader | 270/37 |
| 1,915,221 | 6/1933 | Fitzgerald | 227/81 X |
| 2,105,372 | 1/1938 | Pratt | 270/53 X |
| 2,827,632 | 3/1958 | Faeber | 227/81 |
| 3,275,210 | 9/1966 | McCain et al. | 227/82 |
| 4,196,835 | 4/1980 | Schlough | 227/81 |
| 4,245,766 | 1/1981 | Johnson et al. | 227/39 X |

FOREIGN PATENT DOCUMENTS

| | | | |
|---|---|---|---|
| 656831 | 1/1963 | Canada | 227/81 |

*Primary Examiner*—Paul A. Bell
*Attorney, Agent, or Firm*—Laurence R. Brown

[57] ABSTRACT

Three adjacent continuously running chain link assemblies having two contiguous common paths, respectively in those paths (1) form staples from lengths of wire and (2) insert and clench the staples while creasing a signature passing through the linear path defined by the contiguous chain links. This produces simplified equipment operable at high speeds synchronously on line with signatures from a rotary printing press, or the like.

The wire lengths are handled and formed into staples by very simple non-critical mechanical means constituting a magnetic male die member and female shaping die member carried by respective contiguously traveling chain link assemblies to mate as they move about sprockets into an arcuate path leading into their contiguous mated linear travel path.

Similarly the staples are passed through the signatures and clenched in entering the second contiguous path where incremental chain link carried creasing die sets grasp, transport and crease the signatures over the linear contiguous pathway to present a folded and stapled output signature.

11 Claims, 17 Drawing Figures

HIGH SPEED ON-LINE STITCHER FOR SIGNATURES AND WEBS

TECHNICAL FIELD

This invention relates to means and methods of stitching paper webs, signatures, and the like, and more particularly it relates to high speed stitching apparatus that staples paper webs or printed documents on-line along their travel path, parallel thereto, in high speed printing or collating systems.

BACKGROUND ART

Machinery for stitching signatures is well known in the art. These known machines incorporate mechanisms that form staples from a coil of wire. However, there are many unsolved problems in this art that have previously precluded supplying simple reliable machinery that operates at high speeds such as 60,000 items per hour for on-line incorporation in printing and collating systems with enough versatility to operate both on signatures and webs without restriction in travel direction. A brief description of representative typical prior art patents exhibiting deficiencies corrected by this invention follows.

U.S. Pat. No. 2,869,863—Stobb, Jan. 20, 1959 and U.S. Pat. No. 2,104,852—Crafts, Jan. 4, 1938 represent the class of art that passes signatures through a set of rotating drums where staples are inserted at the line of contact between the drums. Several deficiencies exist in this class of stitching machinery. A major problem is wear and tear and corresponding complex mechanisms requiring high peak impact energy. This is caused by the requirement to eject and clench a staple almost instantaneously in a very small angle of drum rotation as the staples near the adjoining drum surfaces. In addition the staple wire must be very stiff to stand this impact and thus can be expensive and can cause cosmetic problems in the signature. Furthermore, the U-shaped staples must be inserted crosswise to the travel of paper along the line of drum contact so that both points penetrate the paper simultaneously, thus preventing the stapling action when the paper is moving in the perpendicular direction. This many times requires a mechanism in a system for changing travel direction of the signature. Also it in general prevents the on-line stitching of a travelling web before signatures are isolated, because the web must be cut and the signature travel direction changed to use this type of mechanism.

U.S. Pat. No. 1,784,590—Greene, Dec. 9, 1930 and U.S. Pat. No. 2,105,372—Pratt, Jan. 11, 1938 and U.S. Pat. No. 2,693,595—Belluche et al., Nov. 9, 1954 represent a class of stitching machines that staple creased signatures along the crease. While this is desirable in some applications these machines may lack the versatility to handle flat sheets or continuous webs. Also the latter patent is representative of the class of machines that require a separate spool of wire and corresponding staplers for each of the multiple staples to be provided in a signature. This leads to complex machinery tending to be less reliable and high cost since the wire handling and cutting equipment of the prior art is usually complex.

Also Belluche et al. represents the class of stitchers using reciprocating cycle staplers. Such staplers are intermittent and require reciprocation of heavy stapler mechanisms. Also they require attendant synchronizing apparatus in systems processing various types of paper products. The inertia of moving any such relatively heavy apparatus through start-stop cycles at each end of the operation is great, thereby cutting down on potential top reliable speed of operation, and the reliability is low and cost is high for such complex stapling equipment in this mode of operation.

The Belluche et al. apparatus also represents a class of machines which require the signature to stop in transit to receive the staples. Further typical of the piece by piece feeding approach is the U.S. Pat. No. 1,937,979—Reynolds, Dec. 5, 1933. Higher speeds can be obtained reliably by processing continuously moving paper.

U.S. Pat. No. 1,676,156—Rader, July 3, 1928 is representative of stitching machinery requiring such complex and intricate mechanisms that it is very difficult to maintain and to keep in operation reliably over long time period at high operation speeds. Such machinery is unduly expensive. Many machines of this class have extensive and complex mechanisms requiring precision alignment and interaction for forming, transporting and inserting staples, with the attendant problems of jamming and malfunction. These mechanisms are also in general not adaptable to the versatility required to form staples of various lengths for use in signatures of different thicknesses or for handling continuous webs or documents with various travel speeds or directions of travel.

The prior art is replete with complex stapler forming and clinching mechanisms. Some require complex travel paths for wire taken from rolls and complex transport and forming mechanisms. Any system complexity reduces reliability and increases critical downtime and also results in higher cost. Thus the formation of staples from a wire roll, transport of staples and clenching in the paper product is a critical part of any stitching system. In this respect, U.S. Pat. No. 223,252—Smyth, Jan. 6, 1880, uses preformed staples which are transported in part by a magnet in their transit path as shown.

It is therefore an object of this invention to correct the foregoing defects of the prior art and to provide simple non-critical, inexpensive and effective high speed on-line stapling methods and apparatus for processing either continuous webs, individual signatures and other such paper products.

Further objects, features and advantages of the invention will be found throughout the remaining description, drawings and claims.

BRIEF DISCLOSURE OF THE INVENTION

Therefore in accordance with this invention the paper web or signatures are stapled over a longitudinal travel path in the direction of the web travel or the signature crease line. This travel path extends between two chain link mechanisms rotated continuously by sprockets to pass the signatures through at an on-line speed in the order of top speeds of at least 60,000 signatures per hour. The chain links carry thereon simplified low inertia stapling dies so that the forming and clenching of staples takes place relatively slowly over a continuous travel path afforded by the two adjacent transporting chain link mechanisms. The web or signature thus travels at high speed along a linear flow path without change of direction. The plane of the staples is fed parallel to the path of travel of the paper by one of the chain links, thereby permitting an extended time for entry of respective U prongs sequentially along the travel direction into and through the paper to mate with clenching dies in the other chain link. Accordingly, the criticality of stitching at high speeds as provided by prior art stitching systems is removed and simpler more reliable equipment results.

The equipment is further simplified by transporting wire unrolled from a spool and cut into proper length at a cutting station into mating contact with staple forming dies with a transport male die member. The wire is inserted by the male die into a female die member in the rotating chain link assembly that transports the signatures for forming the staple. This provides a long time period in which to form the staple taking little inertia and peak power and removing criticality and wear present in prior art type stapling equipment. Also the staple wire may be thinner since it need not undergo instantaneous impact which tends to bend and crumble such thinner wire in prior art high speed systems.

DESCRIPTION OF DRAWINGS

The drawing sets forth the various novel aspects of the invention, as follows.

DETAILED DESCRIPTION OF A PREFERRED EMBODIMENT

Figure 1:
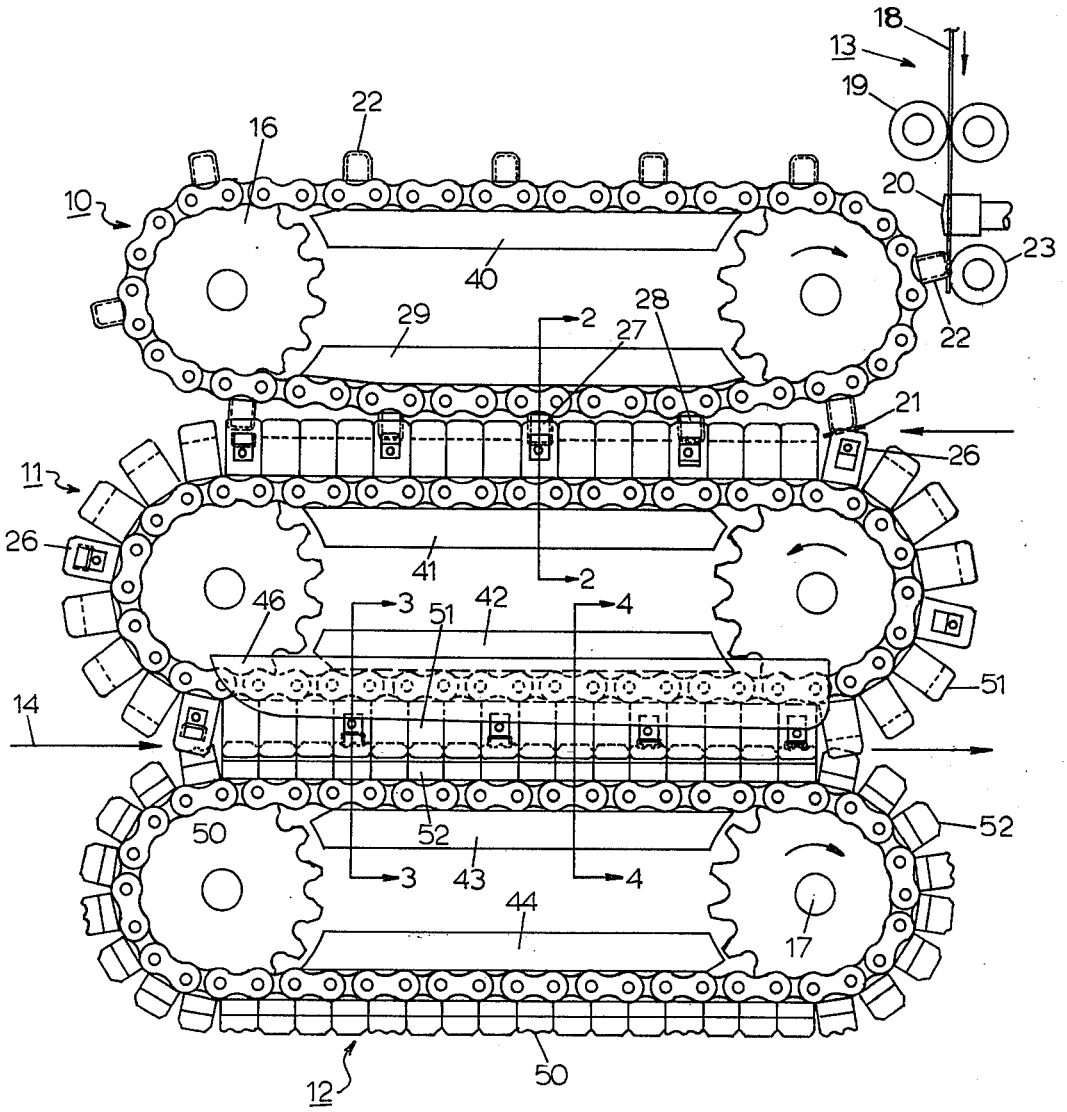
FIG. 1 is an elevation sketch of the signature transport, folding and stapling apparatus afforded by this invention.
Figure 2:
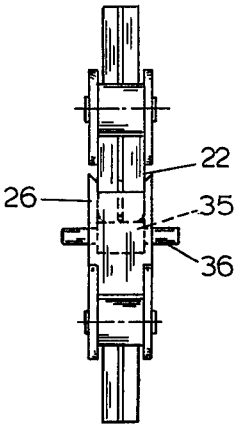
FIG. 2 is an elevation left end sketch of the staple transport and forming mechanism as shown looking into 2—2 of FIG. 1.
Figure 3:
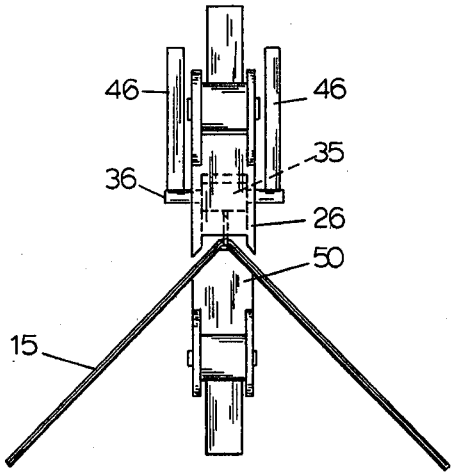
FIGS. 3 and 4 are left end elevation view sketches of the mechanism of FIG. 1 looking into 3—3 and 4—4 respectively, showing a signature in transport through the mechanism.
Figure 4:
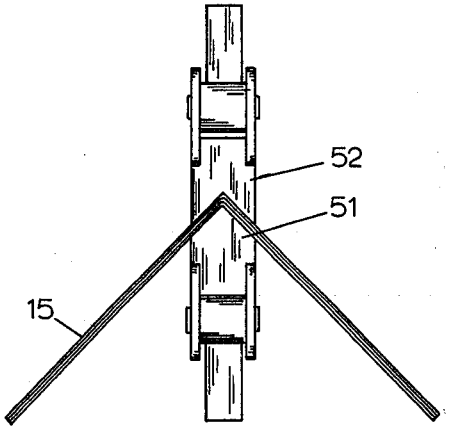

As may be seen from FIGS. 1 to 4, the apparatus afforded by this invention comprises basically three chain link assemblies 10, 11, 12 and a wire cutting assembly 13, sketched to show the critical working element relationships in forming and transporting staples, creasing and stapling web or signature sheets fed into arrow 14 through the linear transport path between chain link assemblies 11 and 12. FIGS. 3 and 4 best show the stapling and creasing of signatures 15 as they pass through the chain link path.

Thus, the chain link assemblies 10, 11, 12 are continuously moved by sprocket wheels 16, etc. rotating in the directions illustrated by arrows about shafts 17, etc. at a speed processing the signatures on line between printing and stacking equipment or in collating equipment. This equipment is capable of signature processing speeds as high as greater than 60,000 signatures per hour.

Figure 5A:
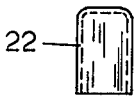
FIGS. 5A and 5B are respectively side and end view sketches of cut wire pick up and magnetic wire staple transport and shaping male die structure.
Figure 5B:
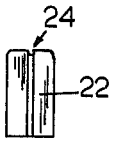
Figure 6A:
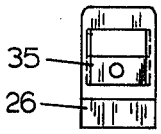
FIGS. 6A and 6B are respectively elevation side and end view sketches of staple forming female dies which form and transport staples and serve as ejection means in stapling the paper products.
Figure 6B:
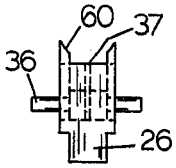
Figure 10:
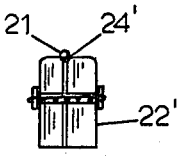
FIG. 10 is an end elevation sketch in section of an alternate friction grasping transport die structure that can be substituted for the die of FIG. 5B.

Wire 18 is fed from a spool (not shown) through rollers 19 and a rotary cutter 20 driven at a synchronous speed with the chain links to supply cut lengths of wire 21 from which staples are formed for pick up transport and shaping by means of the male die and transport members 22 which may either be magnetic members (FIG. 5B) or frictional grasping members (FIG. 10) for brass or stainless steel nonmagnetic wire. Roller 23 is a wire support means aiding in holding and centering the wire for carriage in the grooves 24 (FIGS. 5B, 10) of the male dies 22 carried by the chain links 25. As may be seen from FIG. 10, two parts are spring biased together to form groove 24' which parts are separated by the slightly larger diameter wire 21 to be held frictionally in the groove 24'. The male transport and staple forming dies 22 fit into chain links on chain 10 and are thus carried to mate with female forming dies 26 (FIGS. 6A, 6B) carried by chain 11.

The dies 22 are spaced along the chain link of assembly 10 to provide from a single wire feed 18 a multiplicity of staples which can enter a signature along the linear transport path defined by the contiguous chain assemblies. Thus, a wire 21 is pushed by male die 22 into female die 26 as it travels through the stations shown 27, 28, etc. The cammed guide bar 29 permits the bending of wire 21 and formation of the staple to proceed relatively slowly, even at the high throughput speeds of the signatures, without impact or peak energy requirement, thus contributing to the long wear high reliability feature of this invention. FIG. 2 shows the staples being formed in female dies 26.

Note that the female dies 26 have the sliding piston 35 with cam arm 36. The piston 35 is pushed downwardly to a seated limiting position by male die 22 as the wire 21 is formed into a staple into the grooves 37 of die 26 (FIG. 6B) mating with grooves 24 of male die 22. The staple is held in female die 26 for transport and later ejection.

Figure 7A:
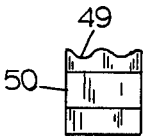
FIGS. 7A and 7B are respectively elevation side and end view sketches of chain link staple clenching and creasing dies.
Figure 7B:
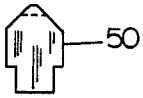

Chain support rails 29, 40 to 44 provide a rigid support path together with the sprocket wheels 16 around the entire length of travel of each chain assembly 10, 11, 12. A staple clenching cam rail 46 is disposed to coact with cam arms 36 to push the staples out of dies 26 through the signatures traveling between chain assemblies 11 and 12 and clenching them in the recesses 49 of mating clenching male dies 50 (FIGS. 7A and 7B). This cam surface 46 then permits an optimum speed of entry of the staple into signatures of various thicknesses which are handled simply by separation of the lower transport chain link assembly 12 to give proper frictional pressure for transport. It is clear that this system is adaptable to use of different length staples primarily by programming the length of wire 18 to be cut at cutter 20.

Figure 8A:
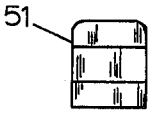
FIGS. 8A and 8B are respectively side and end view sketches of male creasing chain link carried transport dies.
Figure 8B:
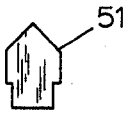
Figure 9A:
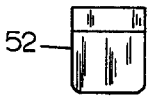
FIGS. 9A and 9B are respectively end and side view sketches of female creasing chain link dies mating with the dies of FIG. 8.
Figure 9B:
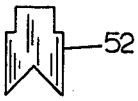
Figure 11A:
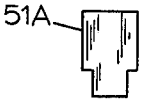
FIGS. 11A and 11B are end elevation sketches of alternate forms of non-creasing dies that can be substituted for the respective dies of FIGS. 8B and 9B.
Figure 11B:
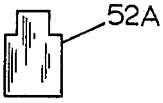

Note that these clenching male dies are adapted to work with creased signatures 15 (FIGS. 3 and 4). Thus, intervening male creasing dies 51 (FIGS. 8A and 8B) serve to provide a continuous crease in cooperation with female creasing dies 52 (FIGS. 9A and 9B) along the entire travel path between chain assemblies 11 and 12 to produce a stapled and creased signature 15 as shown in FIG. 3 exiting the linear transport path. As shown in FIG. 11, however, the creasing is not necessary and flat transport dies 51A, 52A (together with corresponding FIG. 7 clenching dies) may be used to process for example continuous noncreased webs where the signatures will later be cut and creased.

In operation therefore this stitching apparatus transports signatures along a linear path 14 between chain links 11 and 12 either crease down, crease up or flat. The chain link carried creasing and stapling dies 26, 50 and 51, 52 along the contiguous paths of the two chain assemblies 11 and 12 then enter a plurality of staples into the signatures. This plurality of staples is formed in dies 26 from a single wire 18 feed from a spool. It is noted that this assembly is successful at high speed operation partly because the stapling action is slowly accomplished as aided by cam 46 over a long travel path without instantaneous impact to use smaller wire and to stitch U-shape staples into signatures along their crease axis rather than crosswise. Thus the staples are in a novel manner carried in a path alongside and parallel to the transport path of the signatures 14 by chain assembly 11, 12. This capability also is most important since it gives the ability to process continuous webs before isolated into individual signatures. Such could not be done with impact type staplers heretofore dynamically at high travel speeds of the documents because both staple points of necessity in that type operation needed to be entered simultaneously thereby restricting operation to those conditions where signatures were turned to pass the stapler with the crease line perpendicular to the travel path.

However, the staples are passed slowly through the signatures by coaction of camming bar 46 and the cam arm 36 as the signatures are in motion traveling from left to right through the two contiguous chain link carried die sets of assemblies 11 and 12 with less energy at the peak and with simpler stapling dies. Clenching takes place as the staple ends hit clenching recesses 49 of clenching dies 50 (FIG. 7A) which also aid in performing the creasing function by means of their triangular shape 59 mating with the inclined sides 60 (FIG. 6B) of the female staple carrying dies 26.

Thus, the signatures in any event are stapled along their eventual crease line and if desired they are also creased by means of creasing die sets 51, 52, etc. as they move through the linear path in which staples pass through. The chain links meet arcuately in contact at the left end sprocket wheels 16 and thus have an ideal approach as aided by cam 46 for a programmed entry into the signature or web sheets. The contiguous path between the two chain links 11 and 12 is long enough to contain a full signature length with a plurality of staples entered by a plurality of simplified stapler sets along the travel path fed by a single wire 18. Because of this low inertia, low weight, simplified stapler construction, it is evident that high rotary operational speeds can be required. Also because of the removal of impact during the forming and clenching operations it is evident that wear and maintenance of high speed equipment is materially reduced.

The wire 18 if magnetic is cut in lengths 21 that are transported by magnetic male die member 22 and shaped into staples while still carried by the magnetic members 22 as they enter the female shaping dies 26. The magnetic members 22 and corresponding frictional wire grasping members 22′ (FIG. 10) carrying the wires significantly simplify otherwise complex and delicate machinery to handle wire lengths in a novel manner as compared to any known methods of transporting staples in a high speed staple forming mechanism.

Another significant advantage of the present invention is that a change of direction of the flow of wire through the cutter is not necessary to transport the wire to the die for forming a staple. The lack of necessity for more complex transport not only reduces cost and the chance for jamming or mishandling malfunctions but it also makes simple easy to construct equipment possible.

It is particularly important to emphasize the simplicity and light weight of the staple forming and clenching apparatus of this invention. Essentially each stapler is a set of three light weight link chain carried dies 22, 26 and 50. The usage of these three dies in their impactless arcuate path entry over a long travel path also contributes to low energy consumption and high speed reliability. Obvious cost advantages appear in the equipment and its packaging as well as operational and maintenance costs. In this art the cost of unexpected down time due to failure, jamming or malfunction is very high. Thus, clearly this equipment has improved the state of the art and the efficiency of output of attendant systems.

The chain link assemblies, entering and exiting signature transport assemblies together with printing, signature inserting or stacking equipment (not shown) and the wire feed and cutting assembly 13 are all synchronously driven in a typical installation so that the signatures are delivered in position for example for the shown three staples to be centered and spaced in the signature.

It is therefore seen that this simple apparatus is advantageous in removing critical instantaneous power and high wear mechanisms in high-speed on-line transport creasing and stitching apparatus for processing signatures. High throughput speeds in excess of about 60,000 articles per hour are easily attainable under continuous reliable operating conditions requiring little maintenance. Low cost and low power are feasible since no critical delicate hard to manufacture machinery is used and the power requirements are distributed over a very long time period thus avoiding equipment necessary to meet very high peak power loads as compared with fast acting instantaneous rollers or cyclic mechanism. Also the simplicity facilitates access, repair and maintenance when necessary.

The apparatus is very flexible and thus can be used at various speeds and is easily adapted to synchronous operation with on-line operations of high speed rotary printing presses and the like, or alternatively be used for any kind of batch work with continuous or intermittent feed of the signatures, a web or like articles requiring stitching.

Accordingly, those novel features believed descriptive of the spirit and nature of this advance over the art are defined with particularity in the claims.

INDUSTRIAL APPLICATION

A simple, low-cost and reliable high speed on-line impactless stitcher provides multiple staples from a single spool of wire to process continuous webs or separate signatures on-line in collating systems or from high speed rotary presses, or the like, at speeds in the order of 60,000 signatures per hour or higher.

I claim:

1. Apparatus for stitching moving paper articles, comprising in combination:

means transporting the articles along a linear path parallel to a line along which a plurality of staples are to be entered, means transporting a plurality of U-shaped staples along the linear path alongside the articles while passing their prongs through the articles along said line and clenching them, and means creasing the articles along a predetermined crease line as they move through the linear path in which the staples are passed through the article and clenched.

2. Apparatus as defined in claim 1 wherein the means transporting the articles along said linear path comprises two continuously moving chain link assemblies having link carried elements contacting the articles on opposite faces.

3. Apparatus as defined in claim 2 wherein said means creasing the articles comprising sets of male and female creasing dies respectively carried by chain links of said two assemblies.

4. Apparatus as defined in claim 1 including means cutting a wire filament into lengths, male staple forming die means transporting said lengths of wire, and female die means shaping said lengths of wire into a staple moving alongside said male forming dies to mate therewith.

5. Apparatus as defined in claim 4 wherein the male die means shaping said lengths of wire comprises a magnetic member.

6. Apparatus as defined in claim 4 wherein the male die means comprises means frictionally encompassing and grasping the lengths of wire.

7. Apparatus as defined in claim 4 wherein said means transporting said lengths of wire comprises a continuously moving chain link assembly with the male die members carried by separated links in the assembly, the means transporting the articles along the linear path comprises two continuously moving chain link assemblies meeting in said linear path to squeeze said articles between them, and the female die for shaping the lengths of the wire is carried by a link in one of the latter two chain link assemblies.

8. Apparatus as defined in claim 1 including conveyor means bringing the staples into registration with said articles said conveyor means continuously moving at a constant speed over an arcuate path passing in a path parallel to said linear path.

9. Apparatus as defined in claim 8 wherein the arcuate path is defined by a cam surface having a contour establishing the degree of penetration along the travel path.

10. Apparatus as defined in claim 1 including means spacing a plurality of staples along the length of the article in said linear path and means forming the plurality of staples from a single wire filament.

11. Apparatus as defined in claim 1 wherein the transport means for both the articles and staples comprises incremental members carried on a chain link assembly.

* * * * *